United States Patent [19]

Williams

[11] Patent Number: 4,493,285

[45] Date of Patent: Jan. 15, 1985

[54] ADJUSTABLE EXPANDABLE SLIP-ON CANOE BACK REST

[76] Inventor: Donald F. Williams, 53 E. Lakewood Dr., Fenton, Mo. 63026

[21] Appl. No.: 456,857

[22] Filed: Feb. 16, 1983

[51] Int. Cl.[3] ..... B63B 17/00

[52] U.S. Cl. ..... 114/363; 297/350

[58] Field of Search ..... 114/363, 343; 297/350, 297/249, 284, 16, 17, 38, 57, 130, 233, 452

[56] References Cited

U.S. PATENT DOCUMENTS

| | | | |
|---|---|---|---|
| 966,891 | 8/1910 | Dudley | 297/350 |
| 3,909,061 | 9/1975 | Johnson | 297/17 |
| 4,045,834 | 9/1977 | Mason | 297/350 |

*Primary Examiner*—Trygve. M. Blix
*Assistant Examiner*—Jesûs D. Sotelo

[57] ABSTRACT

Adjustable and expandable, slip-on canoe seat back rest. Features provide for mounting without the use of tools to the widest possible range of different canoe and boat seats.

1 Claim, 3 Drawing Figures

ADJUSTABLE EXPANDABLE SLIP-ON CANOE BACK REST

This invention relates to a new and improved back rest device for canoes of various brands. The primary feature of the present invention is to provide a back rest that will easily slip on and off of various canoes without the use of tools.

A further feature of the present invention is to provide adjustments so that it will attach to various canoe seat configurations.

Other features and advantages reside in the details of construction and operation as more fully hereinafter described and claimed, reference being had to the accompanying drawings forming part hereof, wherein like numerals refer to like parts throughout and in which:

Figure 1:
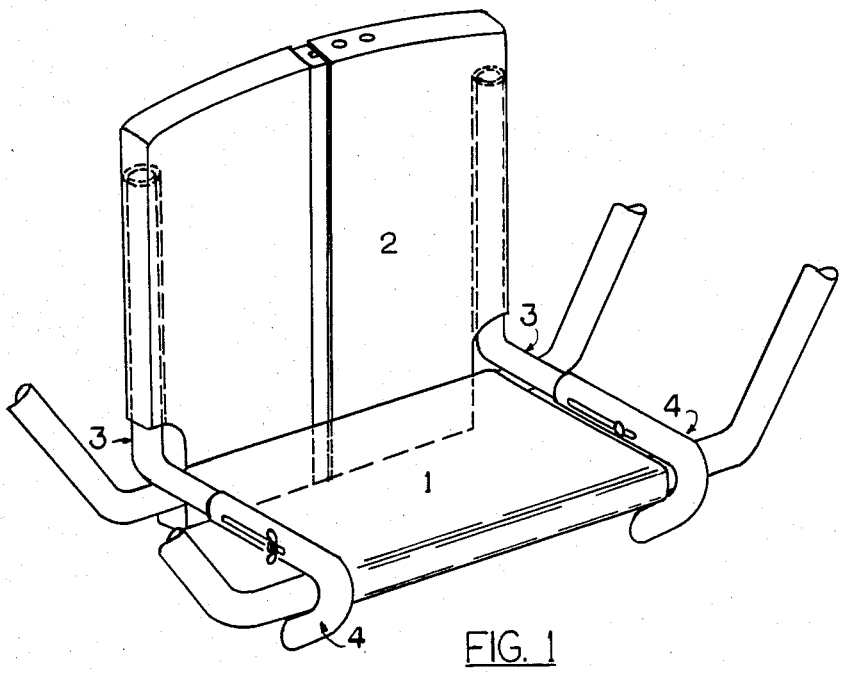
FIG. 1 is an isometric view of a canoe seat with an adjustable slip-on back rest attached.
Figure 2:
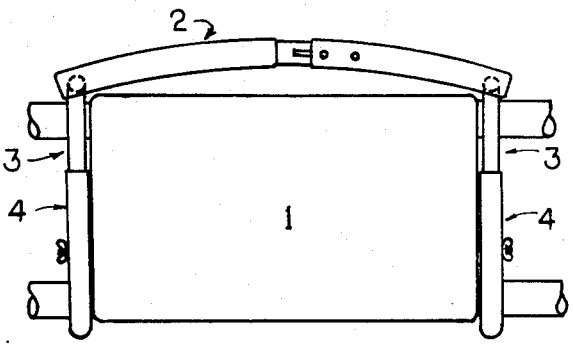
FIG. 2 is a plan view of a canoe seat with attached back rest.
Figure 3:
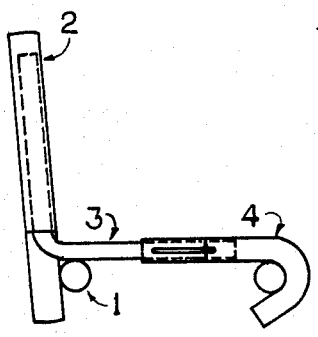
FIG. 3 is an end view of a canoe seat with attached back rest.

The item 1 represents any canoe seat of sufficient design to accept this device.

According to the invention, back rest 2 is secured to the seat by tubings 3 and 4. Tubings 3 attach to back rest 2 by slipping into a tubular cylinder molded as part of back rest. Tubings 3 also slip into tubings 4 providing adjustment to seat size and are held in place with bolt and nut. Tubing 4 has a slot for the slip adjustment.

Further back rest 2 is expandable by use of an overlap two piece construction and secured to each other at top and bottom with two nuts and bolts.

The back rest 2 is produced from molded plastic. Size and shape may vary with different manufacturers.

Tubings 3 and 4 are produced from steel or plastic tubing formed to configurations shown.

What is claimed is:

1. An improvement in a canoe seat backrest which is a unique combination of three adjustments which, when taken all together only, provide for mounting this backrest to the seats of any number of different type canoes, regardless of the confines of the canoe or type seat, and which adjustments are:

A. a two-piece backrest wherein one piece has horizontal adjustment slots at top and bottom and the opposite overlapping piece has a corresponding hole at top and bottom, both pieces are then held together and adjustment in width is provided by means of bolts passing through both top and bottom holes and slots of overlapping two-piece backrest from front with nuts at back;

B. two tubular L-shaped supports of which upright leg of "L" of each support is mounted within a socket at each side of a complete backrest, thereby providing free rotation adjustment of each tubular support for mounting backrest within the angular confines of a canoe's aft seat;

C. two tubular hook-shaped arms, one for each side of a complete backrest, having opposite end of hook sized to slide inside the lower leg of the L-shaped tubing supports, thereby providing adjustment as the hook end of arms together with the lower part of backrest clamping engage the canoe seat.

* * * * *